US008650692B2

(12) United States Patent
Liu et al.

(10) Patent No.: US 8,650,692 B2
(45) Date of Patent: Feb. 18, 2014

(54) CLEANING DEVICE WITH ELECTROSTATIC SHEET AUTO ROLLING

(75) Inventors: Chun-Hsien Liu, Taipei (TW); Ya-Hui Tsai, Taoyuan County (TW); Chun-Sheng Wang, Nantou County (TW); Tung-Chuan Wu, Hsinchu (TW); Lai-Sheng Chen, Hsinchu (TW); Yu-Ting Shih, Hsin Chu (TW)

(73) Assignee: Industrial Technology Research Institute, Hsin-Chu (TW)

( * ) Notice: Subject to any disclaimer, the term of this patent is extended or adjusted under 35 U.S.C. 154(b) by 375 days.

(21) Appl. No.: 13/008,491

(22) Filed: Jan. 18, 2011

(65) Prior Publication Data

US 2012/0110755 A1 May 10, 2012

(30) Foreign Application Priority Data

Nov. 9, 2010 (TW) ..... 99138553 A

(51) Int. Cl.
*A47L 11/00* (2006.01)
*A47L 13/40* (2006.01)

(52) U.S. Cl.
USPC ..... 15/1.51; 15/98

(58) Field of Classification Search
USPC ..... 15/98, 99, 1.51
See application file for complete search history.

(56) References Cited

U.S. PATENT DOCUMENTS 1,356,338 A * 10/1920 Clarke ..... 451/352
2,601,690 A * 7/1952 Georgas ..... 15/99
3,051,973 A * 9/1962 Jacques ..... 15/99
3,945,078 A * 3/1976 Acquaro ..... 15/99
4,562,610 A 1/1986 Davis et al.
5,092,699 A 3/1992 Silvenis (Continued)

FOREIGN PATENT DOCUMENTS

CN 2753277 Y 1/2006
CN 201227236 Y 4/2009
CN 201361003 Y 12/2009
TW 482173 Y 4/2002

OTHER PUBLICATIONS

Teleoperated Cleaning Robots for Use in a Highly Radioactive Environment of the DFDF Kiho Kim, Jangjin Park, Hohee Lee and Keechan Song SICE-ICASE International Joint Conference 2006.
Force Reflecting Remote Robotic Mopping System Kiho Kim, Byungsuk Park and Hodong Kim International Conference on Control, Automation and Systems 2008.
Report of the CES 2010 exhibition Precision Machinery Research & Development Center Shi,Cheng-Tai Mar. 5, 2010.

(Continued)

*Primary Examiner* — Randall Chin
(74) *Attorney, Agent, or Firm* — Morris Manning & Martin LLP; Tim Tingkang Xia, Esq.

(57) ABSTRACT

A cleaning device with electrostatic sheet auto rolling, comprising: a frame; a power gear set; a roller set, having a first roller, a second roller, a paper feeder roller; and a paper collector roller, arranged axially parallel with each other; and a drive shaft; wherein, the paper feeder roller is coaxially received inside a roller of paper; the first, the second and the paper collector rollers are driven to rotate by the power gear set; the paper collector roller is disposed radial to the paper feeder roller at a side thereof while enabling the first and the second rollers to be arranged therebetween; the drive shaft is enabled to move relative to the frame and perpendicular to the axial direction of the drive shaft; the drive shaft is arranged protruding out of the frame; and the drive shaft, the first and the second rollers are arranged parallel to each other.

10 Claims, 8 Drawing Sheets

(56) References Cited

U.S. PATENT DOCUMENTS

| | | | |
|---|---|---|---|
| 5,327,609 | A | 7/1994 | Bierma et al. |
| 5,666,689 | A | 9/1997 | Andersen |
| 7,055,204 | B2 | 6/2006 | Ajluni |
| 7,246,405 | B2 | 7/2007 | Yan |
| 2009/0133204 | A1 | 5/2009 | Lin |

OTHER PUBLICATIONS

State Intellectual Property Office of the People's Republic of China, "Office Action", China, Jun. 5, 2013.

Intellectual Property Office, Ministry of Economic Affairs, R.O.C., "Office Action", Dec. 24, 2013, Taiwan.

* cited by examiner

CLEANING DEVICE WITH ELECTROSTATIC SHEET AUTO ROLLING

CROSS-REFERENCE TO RELATED APPLICATIONS

This non-provisional application claims priority under 35 U.S.C. §119(a) on Patent Application No(s). 099138553 filed in Taiwan, R.O.C. on Nov. 9, 2010, the entire contents of which are hereby incorporated by reference.

TECHNICAL FIELD

The present disclosure relates to a cleaning device with electrostatic sheet auto rolling, and more particularly, to a cleaning device with electrostatic sheet auto rolling that is configured with a self-adjusting drive shaft to be used for adapting the cleaning device to fit with the floor that is to be cleaned in view of enhancing the cleaning performance and efficiency of the cleaning device as the cleaning device is able to contact tightly with the floor even if there are irregularities in the dimensions of the floor or of there is unevenness in the floor surface.

TECHNICAL BACKGROUND

With the rapid development of automation technology and artificial intelligence, robots are becoming more and more common in the human environment and of increasing importance. In recent years, service robots have undergone rapid development, with cleaning robots as the main application. The cleaning robots cover a wide range, and may be classified into industrial and domestic robots according to the World Robotic Survey published by International Federation of Robotics (IFR). Among which, the amount of domestic floor cleaning robots, i.e. robotic vacuum cleaners, have been growing rapidly in recent years, and have become the mainstream product in the market, with an annual output of more than 2.5 million units. It is estimated that the global production value of cleaning robots will grow by six times, from 300 million US dollars in 2007 to 1.8 billion US dollars in 2014, showing great development potential.

However, since most domestic floor cleaning robots that are available today are designed to perform a cleaning operation by vacuuming, people operating such vacuum cleaning robots are generally troubled not only by the noise generated from the vacuum machines embedded inside the vacuum cleaning robots during operation, but also by their poor performance for removing gooey, tacky cruds that adhere to the floor. Therefore, the robotic device using electrostatic cleaning cloths are also very popular since it is favored by its low operation noise, low power consumption and compactness in size.

There are already many related studies available. One of which is a floor cleaning apparatus disclosed in U.S. Pat. No. 5,092,699, entitled "Floor Cleaning Using Index Fabric Rolls in Removable Cassette", in which the provided floor cleaning apparatus comprises: a handle; a housing mounted to the handle; and a cassette, detachably attached to the housing, being configured with a roller for dispensing a fabric. Operationally, a user is able to bring along the roller to rotate with the moving of the handle, and as the fabric is mounted on the roller that are pressed against a floor surface when the floor cleaning apparatus is used by the user to mop the floor, dirt and dust on the floor can be adhered onto the fabric whereas the fabric can be detached from the roller to be washed after each usage so as to be reused. However, the aforesaid floor cleaning apparatus is disadvantageous in that: the fabric had to be manually removed very frequently from the roller to be washed, and the fabric that is mounted on the roller to be rotate therewith may be unfastened or overstretched due to uneven force exerting on the roller that are going to cause poor cleaning performance.

Another such study is a cleaning device disclosed in U.S. Pat. No. 7,055,204, entitled "Cleaning Device", in which the provided cleaning device comprise: a support pad having a planar side to be used for detachably securing an electrostatic cleaning sheet across the planar side; an elongated arm pivotally to the support pad; a rubber squeegee, secured to a side of the support pad opposite to the planar side. With the aforesaid device, not only certain surfaces such as a floor surface can be clean effectively using the electrostatic cleaning sheet, but also other surfaces that can not be cleans effectively by the electrostatic cleaning sheet, such as a glass window, can be clean effectively using the rubber squeegee. However, the aforesaid cleaning device is disadvantageous in that: the electrostatic cleaning sheet had to be manually removed and replaced very frequently, and the electrostatic cleaning sheet being fitted on the planar side of the support pad is not efficient for trailing and thus cleaning surfaces that are not planar surface or have grooves or recess formed thereon.

Further another such study is a self-moving vacuum cleaner disclosed in U.S. Pat. No. 7,246,405B2, entitled "Self-Moving Vacuum Cleaner with Moveable Intake Nozzle", in which the provided self-moving vacuum cleaner includes a vacuum cleaning device and a wiping device that is mounted on a planar plate attached to the rear of the vacuum cleaning device. Operationally, the floor to be cleaned will be vacuumed by the vacuum cleaning device first and then to be brushed by the wiping device, and thereby, any dirt or cruds that are not vacuumed can be picked up by the wiping of the wiping device. However, the aforesaid self-moving vacuum cleaner is disadvantageous in that: the dusting fabric that is attached on the wiping device for cleaning still had to be manually removed and replaced very frequently, and also as the side of the wiping device where the dusting fabric is attached to is a planar surface, the dusting fabric is also not efficient for trailing and thus cleaning surfaces that are not planar surface or have grooves or recess formed thereon. In addition, the vacuuming of the self-moving vacuum cleaner can also be very noisy.

SUMMARY

The present disclosure relates to a cleaning device with electrostatic sheet auto rolling that is configured with a self-adjusting drive shaft to be used for adapting the cleaning device to fit with the floor that is to be cleaned in view of enhancing the cleaning performance and efficiency of the cleaning device as the cleaning device is able to contact tightly with the floor even if there are irregularities in the dimensions of the floor or of there is unevenness in the floor surface.

In an exemplary embodiment, the present disclosure provides a cleaning device with electrostatic sheet auto rolling, comprising:

- a frame;
- a power gear set, mounted on the frame to be used for providing a driving force;
- a roller set, mounted on the frame, being driven to function by the power gear set for transporting a dust cloth while enabling the same to be stretched; and
- a self-adjusting set, mounted on the frame while capable of moving relative to the frame in a reciprocating manner.

Further scope of applicability of the present application will become more apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings which are given by way of illustration only, and thus are not limitative of the present disclosure and wherein.

DESCRIPTION OF THE EXEMPLARY EMBODIMENTS

For your esteemed members of reviewing committee to further understand and recognize the fulfilled functions and structural characteristics of the disclosure, several exemplary embodiments cooperating with detailed description are presented as the follows.

Figure 1:
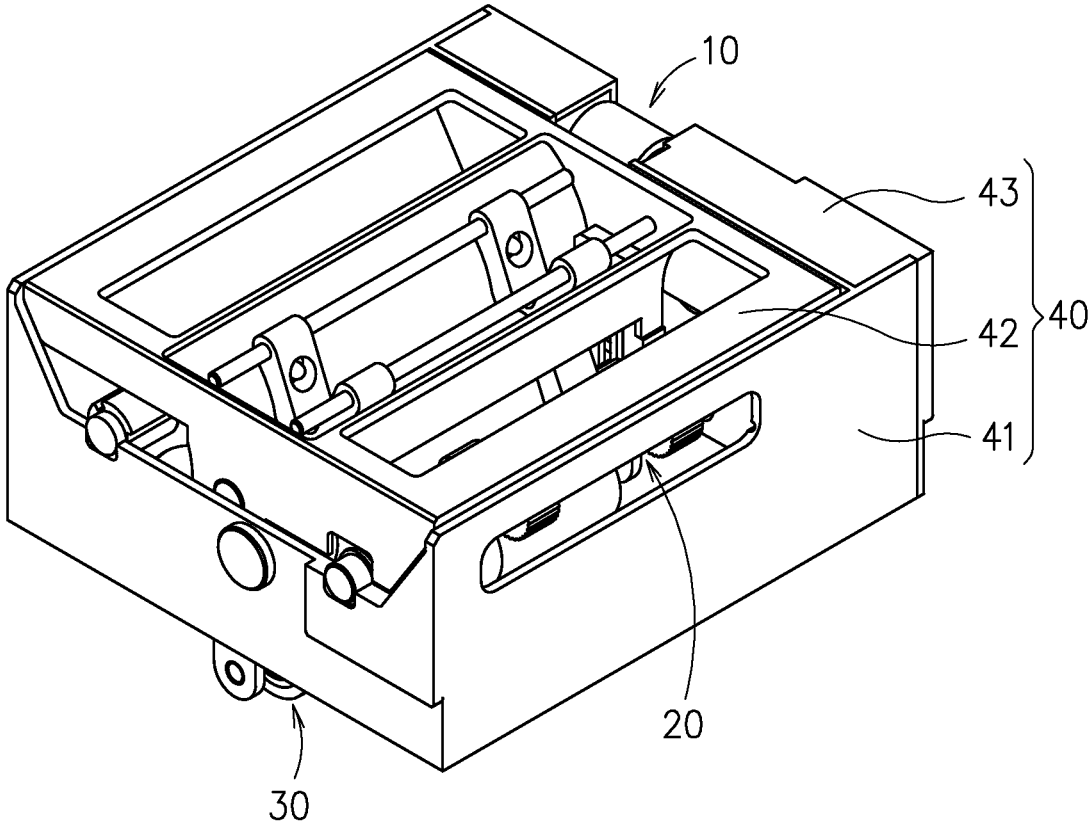
FIG. 1 is a three-dimensional view of a cleaning device with electrostatic sheet auto rolling according to the present disclosure.
Figure 2:
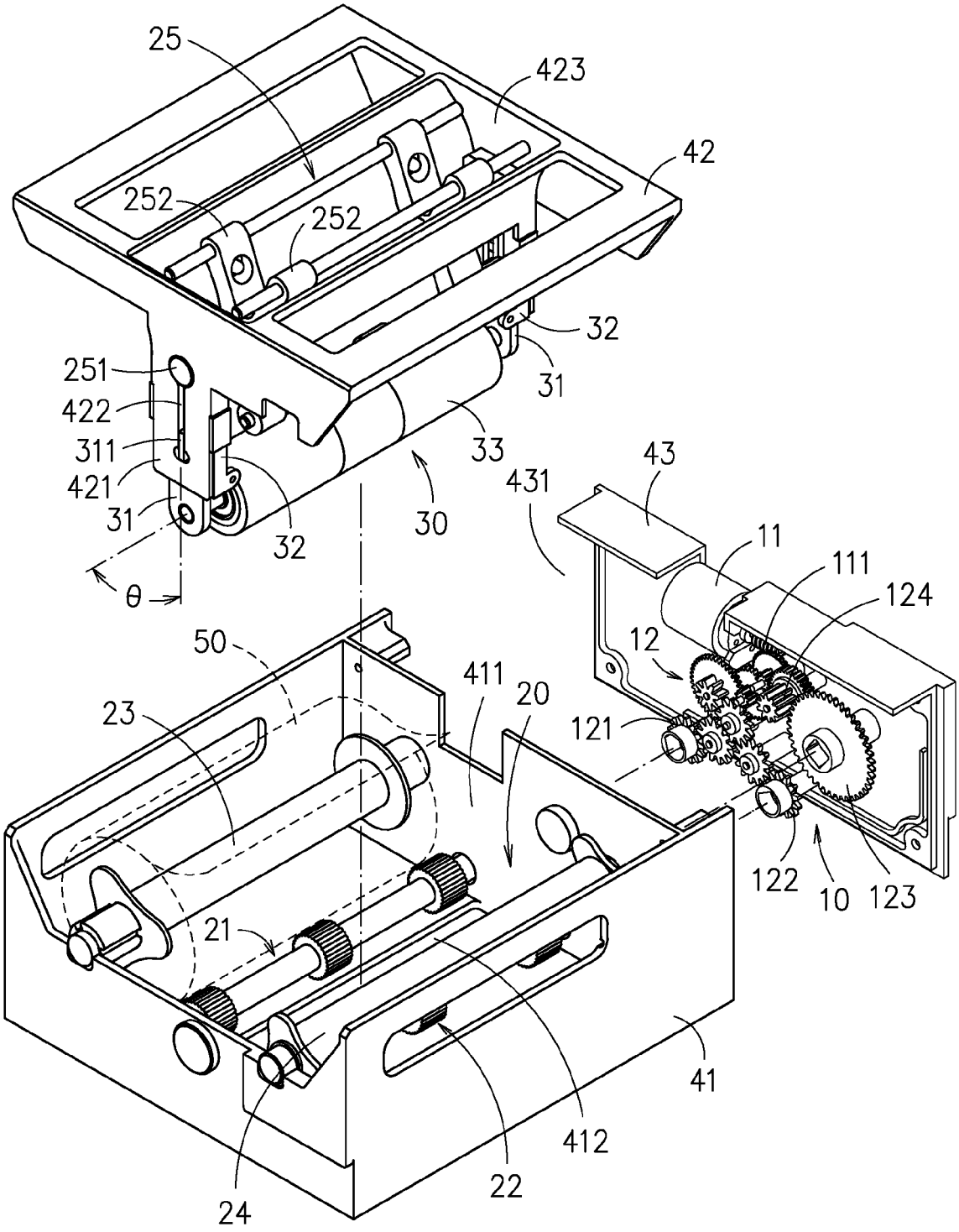
FIG. 2 is an exploded view of a cleaning device with electrostatic sheet auto rolling according to the present disclosure.

Please refer to FIG. 1 and FIG. 2, which show a cleaning device with electrostatic sheet auto rolling according to the present disclosure. The cleaning device with electrostatic sheet auto rolling comprises a power gear set 10, a roller set 20 and a self-adjusting set 30, which are all being received inside a frame 40. The frame 40 is composed of a first rack 41, a second rack 42 and a third rack 43 in a manner that the first rack 41 has a first space 411 formed therein for receiving the roller set 20, and a hollow section 412 formed at the bottom thereof for enabling the self-adjusting set 30 to protrude out of the frame 40 therethrough; the second rack 42 is mounted on the top of the first rack 41 for allowing the self-adjusting set 30 to be mounted to the bottom thereof; and the third rack 43 is disposed at a side of the first rack 41 for allowing a second space 431 to be formed therebetween so as to be provided for receiving the power gear set 10 therein. As shown in FIG. 1 and FIG. 2, the frame 40 formed by the assembling of the first rack 41, the second rack 42 and the third rack 43 is a rectangle-shape structure, but it can be formed into a structure of other shapes by the assembling of the first rack 41, the second rack 42 and the third rack 43, and thus it is not limited by the rectangle-shaped frame 40 shown in the present embodiment.

Figure 3:
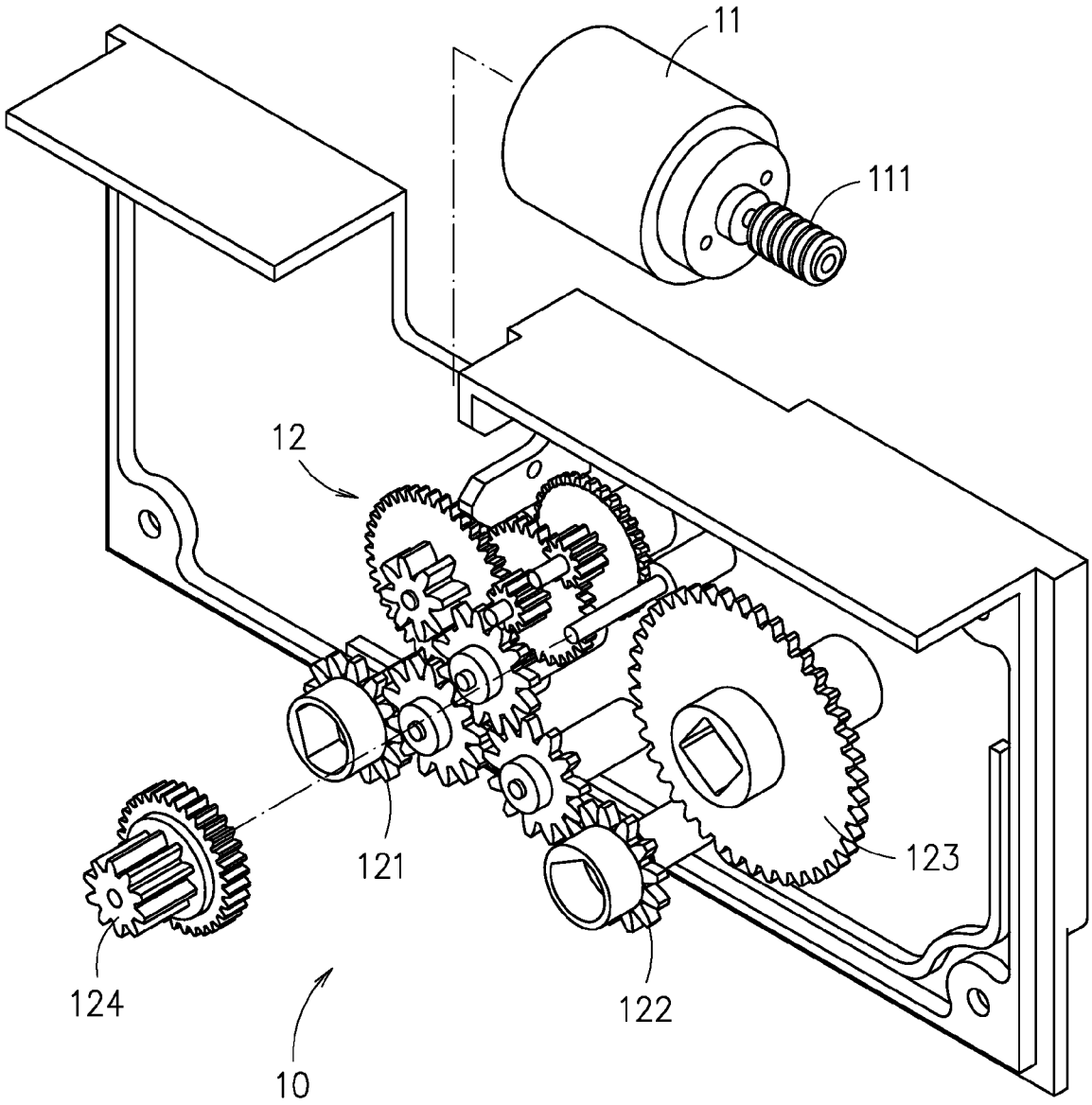
FIG. 3 is an exploded view of a power gear set as the power gear set is mounted to a third rack according to the present disclosure.

As shown in FIG. 2 and FIG. 3, the power gear set 10 includes a motor 11 and a gear set 12, in which the motor 11 is configured with a drive screw 111 that is engaged with the gear set 12 and is electrically connected to a power source for powering the same. In addition, the gear set 12 is composed of a plurality of gears, including a first gear 121, a second gear 122, a paper collector gear 123 and a ratchet gear 124, whereas the ratchet gear 124 is arranged for mating with the paper collector gear 123. When the motor 11 is activated for enabling the drive screw 111 to rotate, the rotating drive screw 111 will bring along the gear set to rotate accordingly. It is noted that the rotation directions of the first gear 121, the second gear 122, the paper collector gear 123 and the ratchet gear 124 are dependent upon how they are coupled to each other for constructing the gear set 12.

Figure 4:
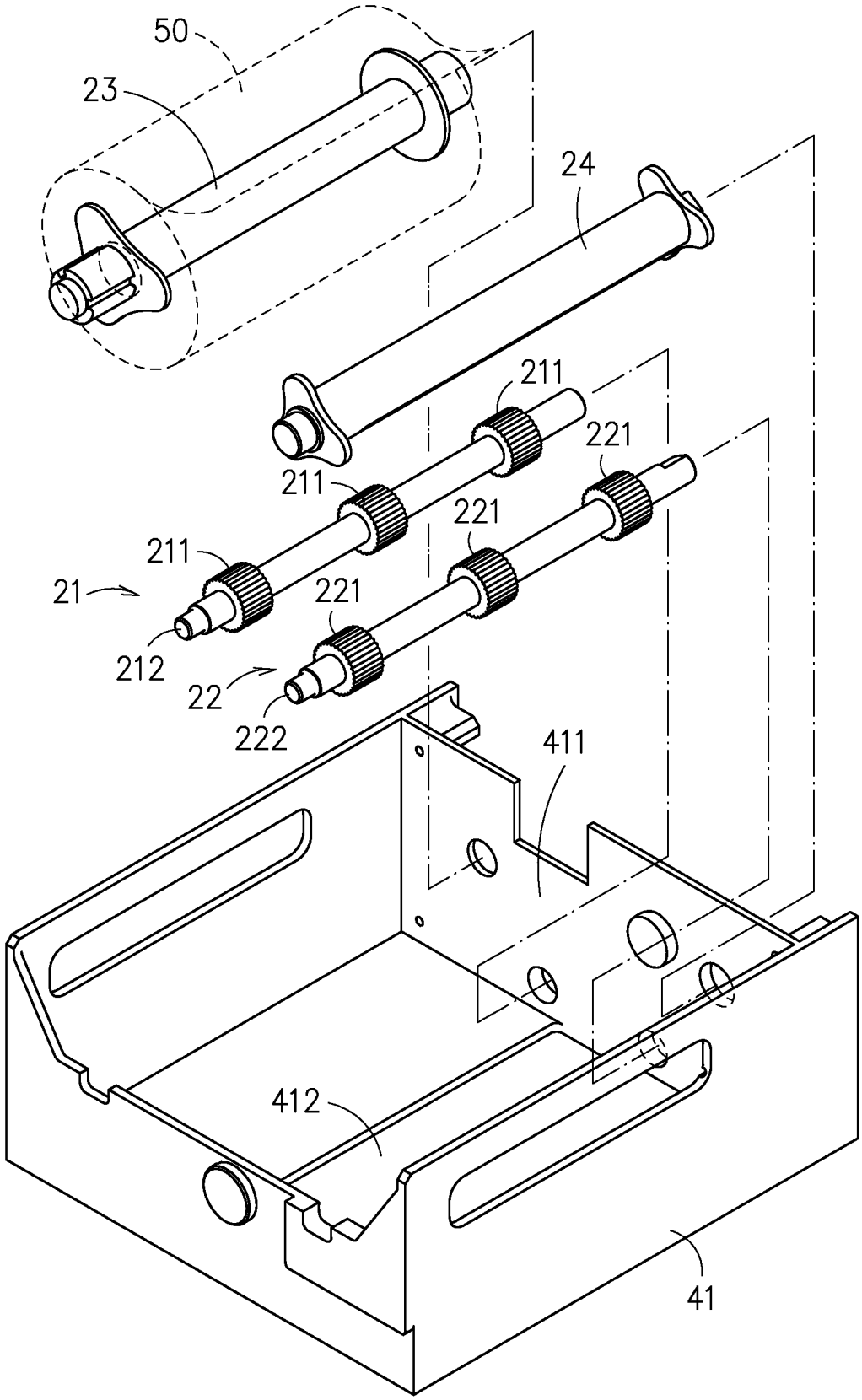
FIG. 4 is an exploded view of a roller set as the roller set is mounted to a first rack according to the present disclosure.

As shown in FIG. 2 and FIG. 4, the roller set 20 is composed of a plurality of rollers, including: a first roller 21 configured with a plurality of first wheels 211 and a first axis 212; a second roller 22 configured with a plurality of second wheels 221 and a second axis 222; a paper feeder roller 23; and a paper collector roller 24; wherein, the first roller 21, the second roller 22, the paper feeder roller 23 and the paper collector roller 24 are arranged axially parallel with each other while all being received inside the first space 411 of the first rack 41, and the paper collector roller 24 is disposed radial to the paper feeder roller 23 at a side thereof while enabling the axes of the two to be arranged at about the same level, and thus enabling the first and the second rollers 21, 22 to be arranged therebetween in a manner that the first roller 21 is disposed next to the paper feeder roller 23 and the second roller 22 is disposed next to the paper collector roller 24. In addition, the first axis 212 of the first roller 21 and the axis 222 of the second roller 22 to be arranged at about the same level, the first axis 212 is axially coupled to the first gear 121, the second axis 222 is axially coupled to the second gear 122, and the paper feeder roller 23 is axially coupled to the paper collector roller 24, so that when the gear set 12 is being driven by the motor 11, the rotating first gear 121, second gear 122 and the paper collector gear 123 will respectively bring along the first roller 21, the second axis 222 of the second roller 22 as well as the plural second wheels 221 mounted thereon, and the paper collector roller 24 to rotate accordingly in directions shown in FIG. 6. It is noted that the paper feeder roller 23 is not connected with any gear, but is pivotally or fixedly attached to the first rack 41 so as to be provided for a roll of dust cloth 50 to mount thereon.

Figure 5:
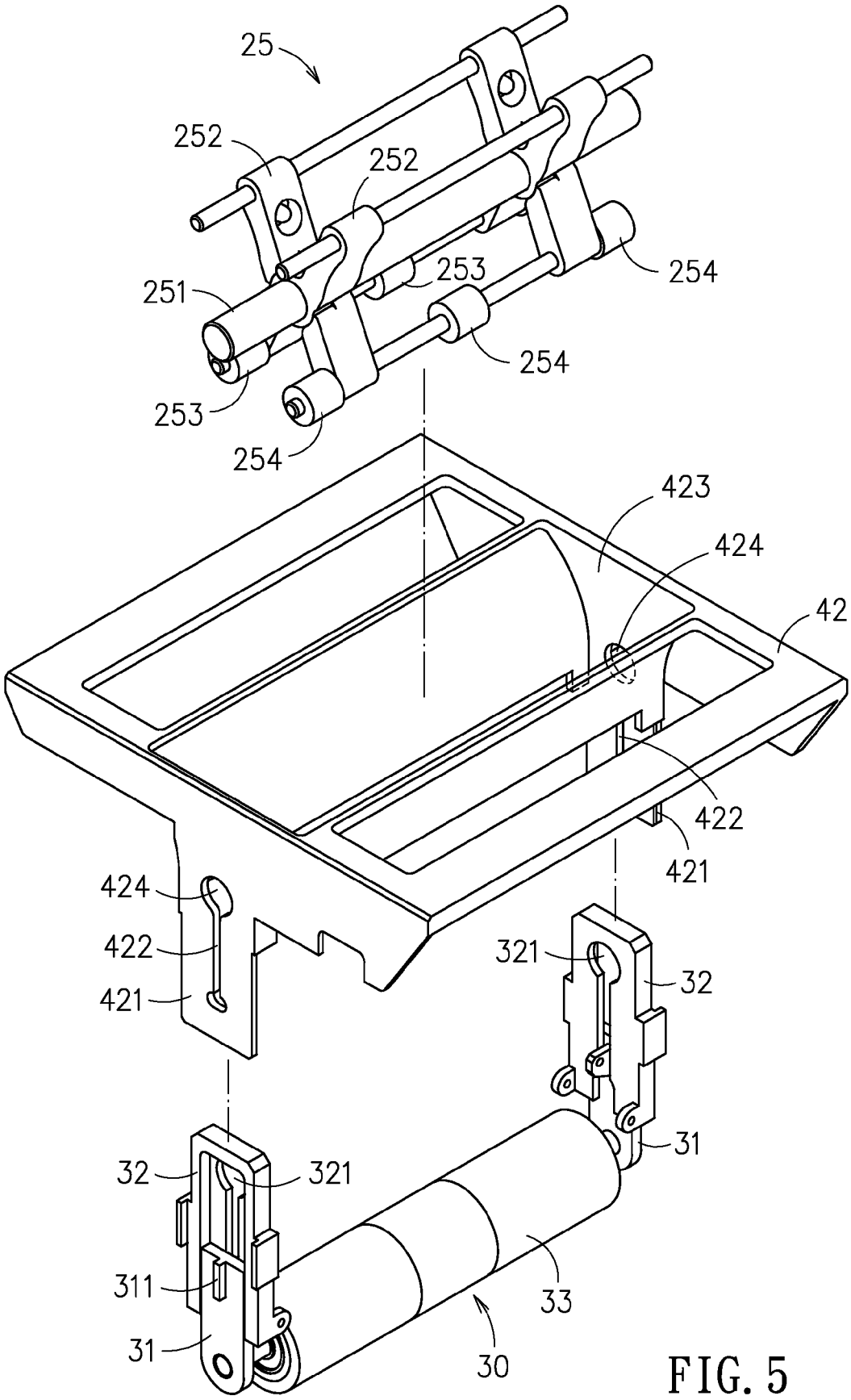
FIG. 5 is an exploded view of a self-adjusting drive shaft as the self-adjusting drive shaft is mounted to a second rack while being coupled to a press roller set according to the present disclosure.

As shown in FIG. 2 and FIG. 5, the second rack 42 has a third space 423 formed on the top thereof, that is used for receiving a press roller set 25. The press roller set 25 is constructed as a X-shaped connecting rod assembly 252 having at least one first press roller 253 and at least one second press roller 254 attached to the bottom thereof while being axially coupled to a positioning axis 251. For receiving the press roller set 25 inside the third space 423, the two ends of the positioning axis 251 are fitted respectively into the positioning holes 424 of the second rack 42 for allowing the press roller set 25 to be arranged at the top of the second rack 42. Moreover, each first press roller 253 is arranged axially parallel with the first axis 212 of the first roller 21 and each second press roller 254 is arranged axially parallel with the second axis 222 of the second roller 22. When the second rack 42 configured with the press roller set 25 is mounted to the top of the first rack 41 where the roller set 20 is fitted therein, each first press roller 253 is arranged abutting against the first wheels 211 of the first roller 21, and each second press roller 254 is arranged abutting against the second wheels 221 of the second roller 22, as shown in FIG. 6.

Figure 6:
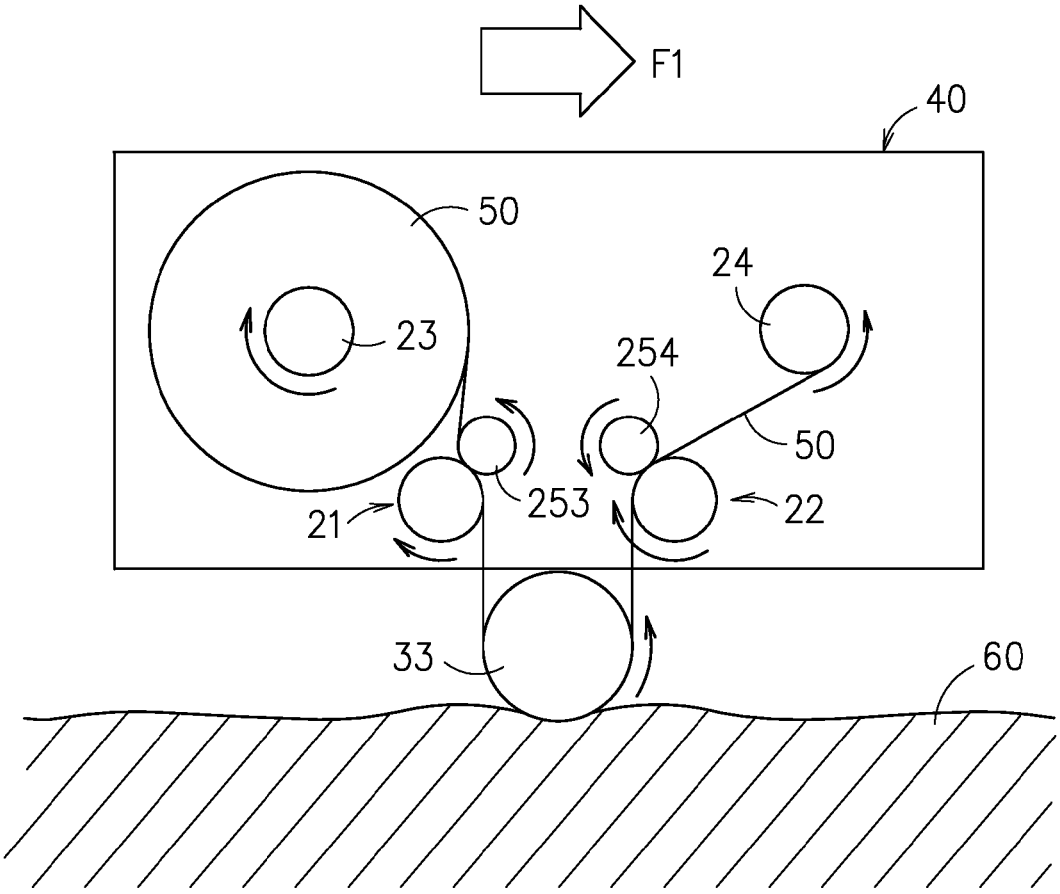
FIG. 6 is a schematic diagram showing a paper feeding path of a dust cloth being enabled by a cleaning device of the present disclosure.

In addition, the self-adjusting set 30 is arranged at the bottom of the second rack 42, as shown in FIG. 2 and FIG. 5, whereas the self-adjusting set 30 has a drive shaft 33, that is arranged protruding out of the frame 40, as shown in FIG. 6, and is configured with two sliding elements 31 in a manner that the two sliding elements 31, each being configured with at least one block 311, are arranged respectively at two axial ends of the drive shaft 33 while being inset respectively into two corresponding positioning members 32 for allowing the same to slide inside their corresponding positioning members 32. In this embodiment, there is a damping spring being arranged at a position between each sliding element 31 and its corresponding positioning member 32. Moreover, the second rack 42 has two protruding pieces 421 that are arranged respectively at positions corresponding to the two positioning members 32 coupling to the two axial ends of the drive shaft 33, and each of the two protruding pieces 421 is formed with a slot 422 extending in a direction for enabling an included angle θ to be formed between the extending direction and the axial direction of the drive shaft 33. As shown in FIG. 5, there is a positioning hole 321 formed on each positioning member 32, by that the two ends of the positioning axis 251 will first inset passing through respectively the two positioning holes of the positioning members 32 and then inset into the positioning holes 424 of the second rack 42, while allowing the blocks 311 to inset into the corresponding slots 422, and thereby, the self-adjusting set 30 can be hanged at the bottom of the second rack 42, as shown in FIG. 2. Thus, when the drive shaft 33 is arranged protruding outside the frame 40, as shown in FIG. 6, the blocks 311 of the two sliding elements 31 that are inset into their corresponding slots 422 are able to slide inside the corresponding slots 422 in synchronization with the sliding of the sliding elements 31 inside their corresponding positioning members 32. In this embodiment, the slot 422 is formed extending in a direction perpendicular to the axial direction of the drive shaft 33, that is the included angle θ is a 90-degree angle. Consequently, the drive shaft 33 is enabled to move relative to the second rack 42 in a reciprocating manner following a direction perpendicular to the axial direction of the drive shaft 33. Moreover, by the suspension enabled by the damping spring disposed between each sliding element 31 and its corresponding positioning member 32 for buffering the sliding of each sliding element 31, the second rack 42 is resiliently mounted to the top of the first rack 41 while allowing the drive shaft 33 to be arranged protruding out of the bottom of the first rack 41 at a position between the first roller 21 and the second roller 22, and enabling the drive shaft 33, the first and the second rollers 21, 22 to be arranged parallel to each other in their axial directions.

It is noted that, in this embodiment, by fitting the two axial ends of the positioning axis 251 into their corresponding positioning holes 321 and 424, the press roller set 25 attached to the X-shaped connecting rod assembly 252 and the drive shaft will be positioned respectively at the top and the bottom of the second rack 42 simultaneously, i.e. by adapting the second rack 42 to be mounted by the press roller set 25 and the drive shaft 33, the space available in the structure of the present disclosure can be fully utilized and thus the structure complexity is reduced. Other than the aforesaid description, the connection between the positioning members 32 and the protruding pieces 421 can be achieved by other means, such as clipping, screwing or adhering. In addition, other then being mounted to the second rack 42, the drive shaft 33 can be mounted to the first rack 41 instead, and also each first press roller 253 and each second press roller 254 can be attached to a H-shape connecting rod assembly instead of the X-shaped connecting rod assembly, only if the connecting rod assembly is capable of enabling each first press roller 253 and each second press roller 254 to be disposed inside the first rack 41 while allowing each first press roller 253 to be arranged abutting against the first roller 21, and each second press roller 254 to be arranged abutting against the second roller 22.

Please refer to FIG. 6, which is a schematic diagram showing a paper feeding path of a dust cloth being enabled by a cleaning device of the present disclosure. As shown in FIG. 6, the roll of dust cloth 50 that is mounted on the paper feeder roller 23 is being transported in a roll-to-roller manner from the paper feeder roller 23 to the paper collector roller 24 in a path passing through the pressing of the first press roller 253 and the first roller 21 to be transported out of the frame 40 while attaching to the periphery of the drive shaft 33 so as to be transported back into the frame 40, and then passing through the pressing of the second press roller 254 and the second roller 22 to the paper collector roller 24.

As shown in FIG. 2 and FIG. 6, operationally when the power gear set 10 is being activated, it will bring along the roller set 20 to rotate accordingly so as to transport the dust cloth 50 from the paper feeder roller 23 to the paper collector roller 24 in a roll-to-roll manner; and when the cleaning device with electrostatic sheet auto rolling is being enabled to move forward, as the F1 direction shown in FIG. 6, by the press of the first and the second press rollers 253, 254, the dust cloth 50 that is being transported during the cleaning device is moving forward can fit completely and smoothly on the roller set 20 and the drive shaft 33 without being slippery, or being damaged or torn apart due to uneven force exerting thereon. In addition, since the drive shaft 33 is enabled to move relative to the frame 40 in a reciprocating manner following a direction perpendicular to the axial direction of the drive shaft 33, the position of the drive shaft 33 can be varied dynamically with the undulation of the floor surface 60 so that the dust cloth 50 is able to contact tightly with the floor surface 60 during the whole cleaning process even if there are irregularities in the dimensions of the floor surface 60 or of there is unevenness in the floor surface 60. Moreover, the ratchet gear 124, as the one shown in FIG. 2, is used for preventing the dust cloth 50 from being torn apart by any uneven force from the roller set 20, and moreover, it is designed to make a creaking sound when the roll of the dust cloth 50 is being transported completely out of the paper feed roller 23 and to the paper collector roller 24 so as to remind a user that it is time to change a new roll of dust cloth 50.

Figure 7:
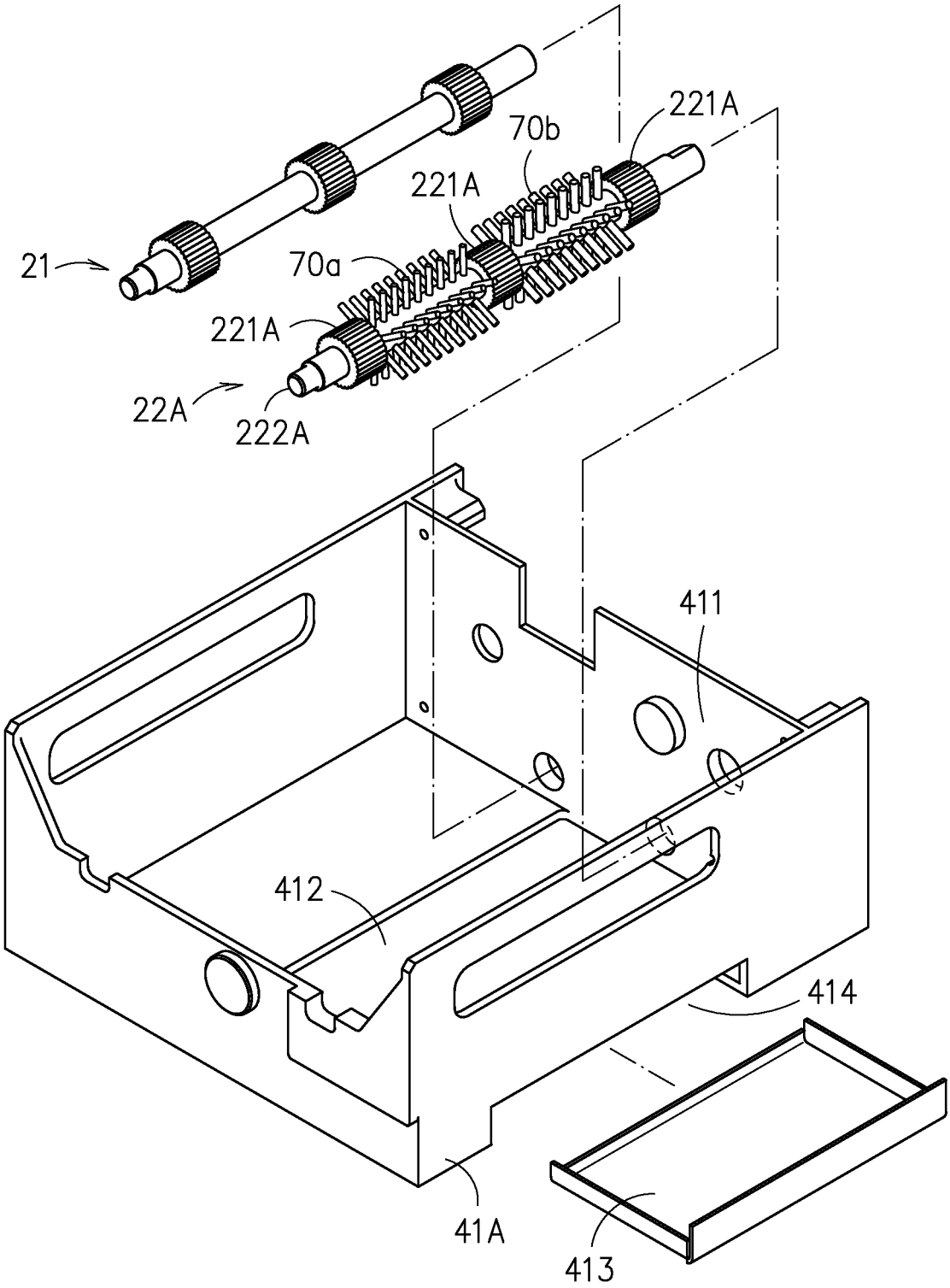
FIG. 7 is a schematic diagram showing how to attach a wiping unit to the cleaning device of the present disclosure.
Figure 8:
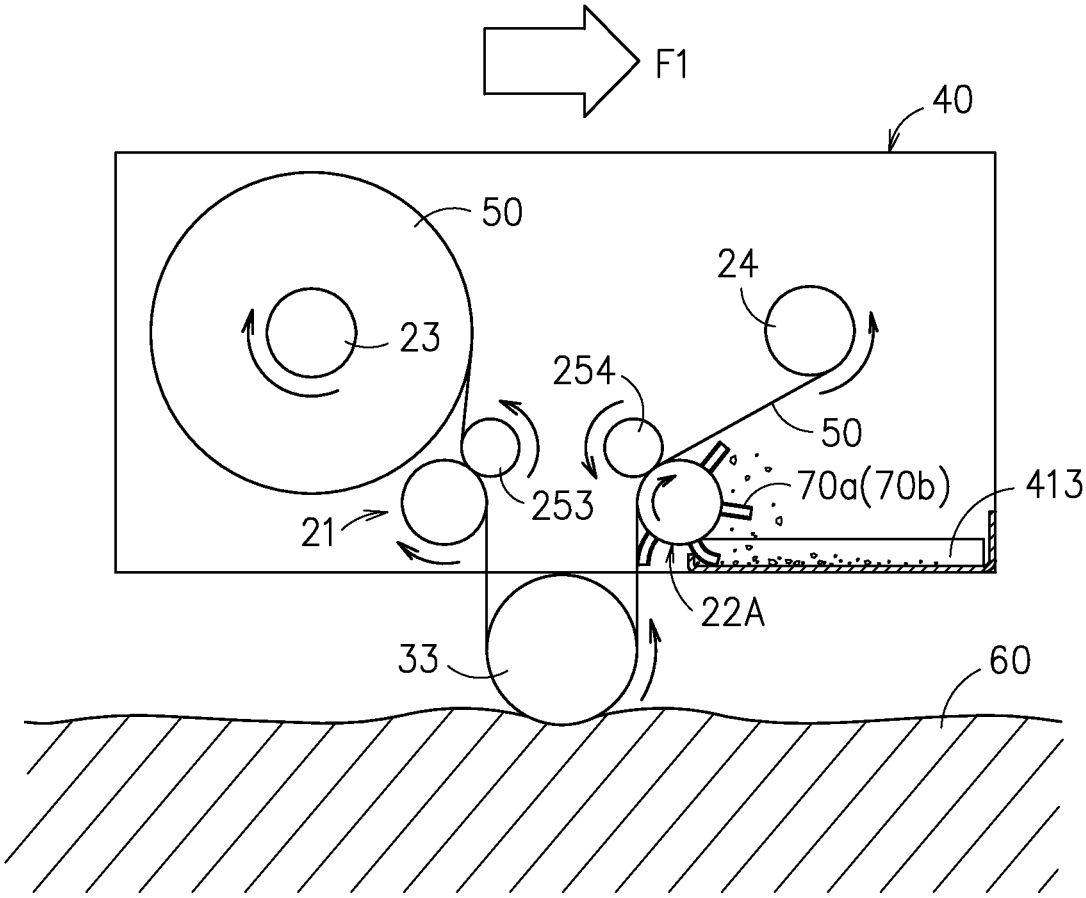
FIG. 8 is a schematic diagram showing a paper feeding path of a dust cloth being enabled by a cleaning device of the present disclosure as the cleaning device is configured with a wiping unit.

As shown in FIG. 7 and FIG. 8, the second roller 22A, which is basically constructed the same as those disclosed in FIG. 2 and FIG. 4, is similarly composed of a plurality of second wheels 221A and a second axis 222A, but is different in that: second roller 22A has a wiping unit mounted thereon, and the wiping unit is configured with a first brush member 70*a* and a second brush member 70*b* that are disposed between the two second wheels 221A. In this embodiment, the brushes of the first brush member 70A are finer than those of the second brush member 70*b*. Moreover, the wiping unit further has a tray 413 disposed below the first brush member 70*a* and the second brush member 70*b*. As shown in FIG. 7, the first rack 41A is formed with a hollow section 414 at the bottom thereof, by which the tray 413 can be inset into the hollow section 414. It is noted that other than the wiping unit that is composed of the first brush member 70*a*, the second brush member 70*b* and the tray 413, the other components in the cleaning device are all the same as those described in the previous embodiments. Thus, operationally when the cleaning device is being enabled to move forward, as the F1 direction shown in FIG. 8, the dust cloth 50 will be transported from the paper feeder roller 23 to the paper collector roller 24 in a roll-to-roll manner in a path passing through the pressing of the first press roller 253 and the first roller 21 to be transported out of the frame 40 while attaching to the periphery of the drive shaft 33 so as to be transported back into the frame 40, and then passing through the pressing of the second press roller 254 and the second roller 22A to the paper collector roller 24. It is noted that at the time when the dust cloth 50 is transported passing through the pressing of the second press roller 254 and the second roller 22A, dust or other miscellaneous objects that are attached to the surface of the dust cloth 50 can be removed by the brushing of the first brush member 70*a* and the second brush member 70*b* while allowing those dust or other miscellaneous objects to fall directly onto the tray 413, and then the tray 413 can be withdrawn out of the cleaning device so as to be cleaned. Thereby, by the brushing of the wiping unit for removing the dust and dirt collected on the dust cloth 50, not only the flatness of the roll of dust cloth 50 that is being collected onto the paper collector roller 24 is enhanced, but also there may be certain used rolls of the dust cloth 50 that can be recycled. As shown in FIG. 7 and FIG. 8, the first brush member 70*a* and the second brush member 70*b* are integrally formed with the second roller 22A, by that not only they will occupy less space, but also no additional driving device will be required for driving the first brush member 70*a* and the second brush member 70*b*. However, the first brush member 70*a* and the second brush member 70*b* can be mounted onto a shaft independent from the second roller 22A that is to be driven to rotate by another driving unit. Moreover, the first brush member 70*a* and the second brush member 70*b* can be disposed at any position at will, only if they are disposed on the feeding path of the dust cloth 50 before it is received by the paper collector roller 24. It is noted that there is also no restriction relating to the amount, the configuration and the brush of the first brush member 70*a* and the second brush member 70*b*, and thus there can be a plurality of brush members being mounted on the second roller 22A whereas each of the brush member can be configured with brushes of the same type or can be configured of a mixture of various brushes.

To sum up, the present disclosure provides a cleaning device, featuring in that: with its electrostatic sheet auto rolling capability for collecting dust and dirt, the noise being generated during the cleaning process can be effectively reduced and the energy consumption can be also reduced as well since no vacuum is required; with the one-directional auto rolling of the dust cloth enabled by the configuration of the roller set, it can ensure the clean device to engage the floor with fresh new dust cloth all the time during the cleaning process and thus, dust and dirt on the floor can be removed smoothly by the electrostatic of the dust cloth while the used dust cloth is being collected and received to the paper collector roller for preventing the floor from being contaminated by the used dirty dust cloth; with the self-adjusting drive shaft for adapting the cleaning device to fit with the floor that is to be cleaned, the cleaning performance and efficiency of the cleaning device can be enhanced as the cleaning device is able to contact tightly with the floor even if there are irregularities in the dimensions of the floor or of there is unevenness in the floor surface; with the design of the ratchet gear in the power gear set, the dust cloth can be prevented from being overstretched or even torn apart due to uneven force exerting thereon during the auto rolling of the dust cloth, and moreover, the ratchet gear is designed to make a creaking sound when the roll of the dust cloth is being transported completely out of the paper feed roller and to the paper collector roller so as to remind a user that it is time to change a new roll of dust cloth; and with the configuration of the wiping unit, not only the flatness of the roll of dust cloth that is being collected onto the paper collector roller is enhanced, but also there may be certain used rolls of the dust cloth that can be recycled. Moreover, by the modularized design of the cleaning device of the present disclosure, the cleaning device of the present disclosure can work independently or can be integrated into and thus work cooperatively with any conventional robotic cleaners or vacuum machines.

With respect to the above description then, it is to be realized that the optimum dimensional relationships for the parts of the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

What is claimed is:

1. A cleaning device, comprising:

a frame;

a power gear set, mounted on the frame to be used for providing a driving force;

a dust cloth;

a roller set, mounted on the frame, being driven to function by the driving force of the power gear set for transporting the dust cloth while enabling the same to be stretched; and a self-adjusting set, mounted on the frame while capable of moving relative to the frame in a reciprocating manner, wherein an outer surface of the self-adjusting set is in contact with the dust cloth;

wherein the frame further comprises:

a first rack, having a first space formed therein for receiving the roller set, and a hollow section formed at the bottom thereof for enabling the self-adjusting set to protrude out of the frame therethrough;

a second rack, mounted on the top of the first rack for allowing the self-adjusting set to be mounted to the bottom thereof; and a third rack, disposed at a side of the first rack for allowing a second space to be formed therebetween so as to be provided for receiving the power gear set therein.

2. The cleaning device of claim 1, further comprising:

a wiping unit, provided for performing a cleaning operation upon the surface of the dust cloth.

3. The cleaning device of claim 2, wherein the wiping unit further comprises:

a brush member, coupled to the power gear set for enabling the same to bring along the brush member to rotate and thus brushing through the surface of the dust cloth; and a tray, disposed below the brush member for receiving miscellaneous objects being removed from the surface of the dust cloth by the brushing of the brush member.

4. A cleaning device, comprising:

a frame;

a power gear set, mounted on the frame to be used for providing a driving force;

a dust cloth;

a roller set, mounted on the frame, being driven to function by the driving force of the power gear set for transporting the dust cloth while enabling the same to be stretched; and a self-adjusting set, mounted on the frame while capable of moving relative to the frame in a reciprocating manner, wherein an outer surface of the self-adjusting set is in contact with the dust cloth;

wherein the roller set further comprises a plurality of rollers including a first roller, a second roller, a paper feeder roller, and a paper collector roller, being configured in a manner that the first roller, the second roller, the paper feeder roller and the paper collector roller are arranged axially parallel with each other while enabling the first roller, the second roller, and the paper collector roller to be driven to rotate by the driving force of the power gear set, and the paper collector roller is disposed radial to the paper feeder roller at a side thereof while enabling the first and the second rollers to be arranged therebetween in a manner that the first roller is disposed next to the paper feeder roller and the second roller is disposed next to the paper collector roller.

5. A cleaning device, comprising:

a frame;

a power gear set, mounted on the frame to be used for providing a driving force;

a dust cloth;

a roller set, mounted on the frame, being driven to function by the driving force of the power gear set for transporting the dust cloth while enabling the same to be stretched; and a self-adjusting set, mounted on the frame while capable of moving relative to the frame in a reciprocating manner, wherein an outer surface of the self-adjusting set is in contact with the dust cloth;

wherein the self-adjusting set has a drive shaft that is arranged protruding out of the frame, and the drive shaft has two sliding elements that the two sliding elements, each being configured with at least one block, are arranged respectively at two axial ends of the drive shaft while being inset respectively into two corresponding positioning members; and a second rack has two protruding pieces that are arranged respectively at positions corresponding to the two positioning members coupling to the two axial ends of the drive shaft, and each of the two protruding pieces is formed with a slot extending in a direction for enabling an included angle to be formed between the extending direction and the axial direction of the drive shaft while enabling the blocks of the two sliding elements to inset into their corresponding slots when the two protruding pieces are coupled to their corresponding positioning members, and thus enabling the blocks to slide inside the corresponding slots in synchronization with the sliding of the sliding elements inside their corresponding positioning members.

6. The cleaning device of claim 5, wherein there is a suspension unit being arranged at a position between each sliding element and its corresponding positioning member.

7. A cleaning device, comprising:

a frame;

a power gear set, mounted on the frame to be used for providing a driving force;

a dust cloth;

a roller set, mounted on the frame, being driven to function by the driving force of the power gear set for transporting the dust cloth while enabling the same to be stretched; and a self-adjusting set, mounted on the frame while capable of moving relative to the frame in a reciprocating manner, wherein an outer surface of the self-adjusting set is in contact with the dust cloth;

wherein the power gear set further comprises:

a motor;

a gear set, capable of being driven to rotate by the motor and being composed of a plurality of gears including a first gear, a second gear and a paper collector gear, being configured in a manner that the first gear is axially coupled to the first roller, the second gear is axially coupled to the second roller, and the paper collector gear is axially coupled to the paper collector roller, and thereby, the first gear, the second gear and the paper collector gear are capable of respectively bringing along the first roller, the second roller and the paper collector roller to rotate when the gear set is being driven to rotate by the motor.

8. The cleaning device of claim 7, wherein the gear set further comprises a ratchet gear, arranged for mating with the paper collector gear.

9. A cleaning device, comprising:

a frame;

a power gear set, mounted on the frame to be used for providing a driving force;

a dust cloth;

a roller set, mounted on the frame, being driven to function by the driving force of the power gear set for transporting the dust cloth while enabling the same to be stretched; and a self-adjusting set, mounted on the frame while capable of moving relative to the frame in a reciprocating manner, wherein an outer surface of the self-adjusting set is in contact with the dust cloth;

wherein the roller set further comprises: at least one first press roller and at least one second press roller, and each of the first and the second rollers is mounted to the frame in a manner that each first press roller is arranged axially parallel with the first roller while enabling each first press roller to be arranged abutting against the first roller, and each second press roller is arranged axially parallel with the second roller while enabling each second press roller to be arranged abutting against the second roller.

10. The cleaning device of claim 9, wherein the first and the press rollers are mounted to a bracket, and the bracket is configured with a positioning axis to be used for positioning the bracket along with the first and the press rollers inside the frame.

* * * * *